United States Patent [19]

Payne

[11] Patent Number: 5,076,072

[45] Date of Patent: Dec. 31, 1991

[54] EARRING POST FOR PIERCED EARS

[76] Inventor: Susan M. Payne, 7010 Old Winder Hwy., Braselton, Ga. 30517

[21] Appl. No.: 550,106

[22] Filed: Jul. 9, 1990

Related U.S. Application Data

[63] Continuation of Ser. No. 401,429, Aug. 31, 1989, Pat. No. 5,020,338.

[51] Int. Cl.[5] ..... A44C 7/00

[52] U.S. Cl. ..... 63/12; 63/13; 63/29.1; 24/711.1

[58] Field of Search ..... 63/12, 13, DIG. 3, 29.1; 24/711.1

[56] References Cited

U.S. PATENT DOCUMENTS

| | | | |
|---|---|---|---|
| 396,661 | 1/1889 | Luthy | 63/12 X |
| 1,073,881 | 9/1913 | Wals | 24/711.1 |
| 1,361,204 | 12/1920 | Udser | 24/711.1 |
| 4,129,998 | 12/1978 | Ferro | 63/12 |
| 4,214,456 | 7/1980 | Hannum | 63/12 |
| 4,543,804 | 10/1985 | Cappiello | 63/12 |

FOREIGN PATENT DOCUMENTS

| | | | |
|---|---|---|---|
| 2113528 | 8/1983 | United Kingdom | 63/12 |

*Primary Examiner*—Laurie K. Cranmer
*Attorney, Agent, or Firm*—Hopkins & Thomas

[57] ABSTRACT

An earring post for pierced ears is disclosed, the post being split at its distal end to form one or more prongs. The prongs are held together by a slidable sleeve or the fingers, the prongs thus being in a tensioned state in generally axial alignment with the post. Upon insertion, the prongs are released by the fingers or by sliding the sleeve away from the prongs, thus assuming their resting position biased out of axial alignment with the post for retaining the post in place.

11 Claims, 3 Drawing Sheets

EARRING POST FOR PIERCED EARS

This is a continuation of copending application Ser. No. 401,429, filed on 8/31/89now Patent No. 5,020,338.

BACKGROUND OF THE INVENTION

1. Field Of The Invention

This invention pertains to an improved pierced earring post, and more particularly to a pierced earring post with an improved securing method. The invention provides a pierced earring post that may be securely fastened to a pierced earlobe without the use of a separate fastener for the post.

2. Description Of The Prior Art

A common means of fastening ornaments to the ear is to pierce the earlobe and to insert posts or wires through the resulting hole. Once inserted, securing the post or wire to the earlobe is necessary. If unsecured, the post or wire would slide out of the ear, and the ornament would be lost. This is a particular problem when the earring ornament is a precious gem. The primary means used to secure pierced earring post to an earlobe is a back fastener. Whether of screw-type or sliding-type, all back fasteners are separate pieces which secure the post to the ear by being releasably secured to the post on the side of the earlobe opposite the ornament, normally applied from the front of the earlobe and the back fastener is then secured from the back of the earlobe.

Securing methods are not the only concern with pierced earrings. Because earrings are inserted into a wound when the ears are initially pierced, the material composition of the earring post must not promote infection. For this reason, the set of earrings worn while the earlobe is healing is typically gold or a hypo-allergenic metal. For some persons, infection may continue to be a concern even after the wounds have healed, and they may have to continue to wear gold or hypo-allergenic earrings.

Current earring post technology suffers from a number of disadvantages. First, because the back fastener is a separate piece, it is easily lost, which often results in the loss of the earring ornament also. Further, many people consider back fasteners unattractive on the back of the earlobe, or they may find the compression of the earlobe uncomfortable. In addition, gold or hypo-allergenic metals are expensive and the cost is increased many times because many earring wearers own a number of different earrings. Posts are permanently affixed to earring ornaments and for every new ornament desired a new post must also be bought.

SUMMARY OF THE INVENTION

Therefore, it is an object of the present invention to provide an improved pierced earring post. A principal object of this invention is to provide an improved method of fastening a pierced earring post to an earlobe. It is a further object of the present invention to eliminate the possibility of losing the fastener which secures the earring post in place and thus losing the earring ornament itself. It is another object of the invention to provide a more attractive means of securing pierced earring posts in the earlobe.

A still further object of the present invention is to provide a less expensive and hypo-allergenic earring post and to eliminate the need to buy earring posts each time an earring ornament is bought.

These and additional objects are attained by the present invention which relates to a self-contained earring for pierced ears. The present invention overcomes all of the above-mentioned disadvantages of the prior art. Possible loss of the fastening means is obviated by the use of a post with a flexible tip that is biased to assume a position different from the axial position. In another embodiment, a sleeve is provided around the tip, which sleeve is slidable to allow the tip to deflect or to return to an axial position. The end of the post is split, allowing the tip to deflect as the sleeve slides along the post. The post is inserted from the front of the earlobe by sliding the sleeve toward the post tip. As the post tip is inserted into the hole in the earlobe, the sleeve is moved toward the mounting face at the front of the earlobe, which allows the post tip to deflect and secures the tip to the earlobe back.

The present invention can be made of plastic, which does not irritate the ears or cause infection. The use of plastic as compared to precious metals also greatly reduces the cost of producing the post themselves. The present invention further reduces the cost of producing the earring because the post can be independent of the earring ornament. The post of the present invention includes a mounting face to be worn at the earlobe front. Various ornaments may be mounted on the earring post by sliding the ornament over the mounting face. The cost of earrings is reduced because ornaments and posts may be sold independently. Thus, a person desiring numerous ornaments would need to buy only a single set of posts.

DETAILED DESCRIPTION OF THE PREFERRED EMBODIMENT

Figure 1:
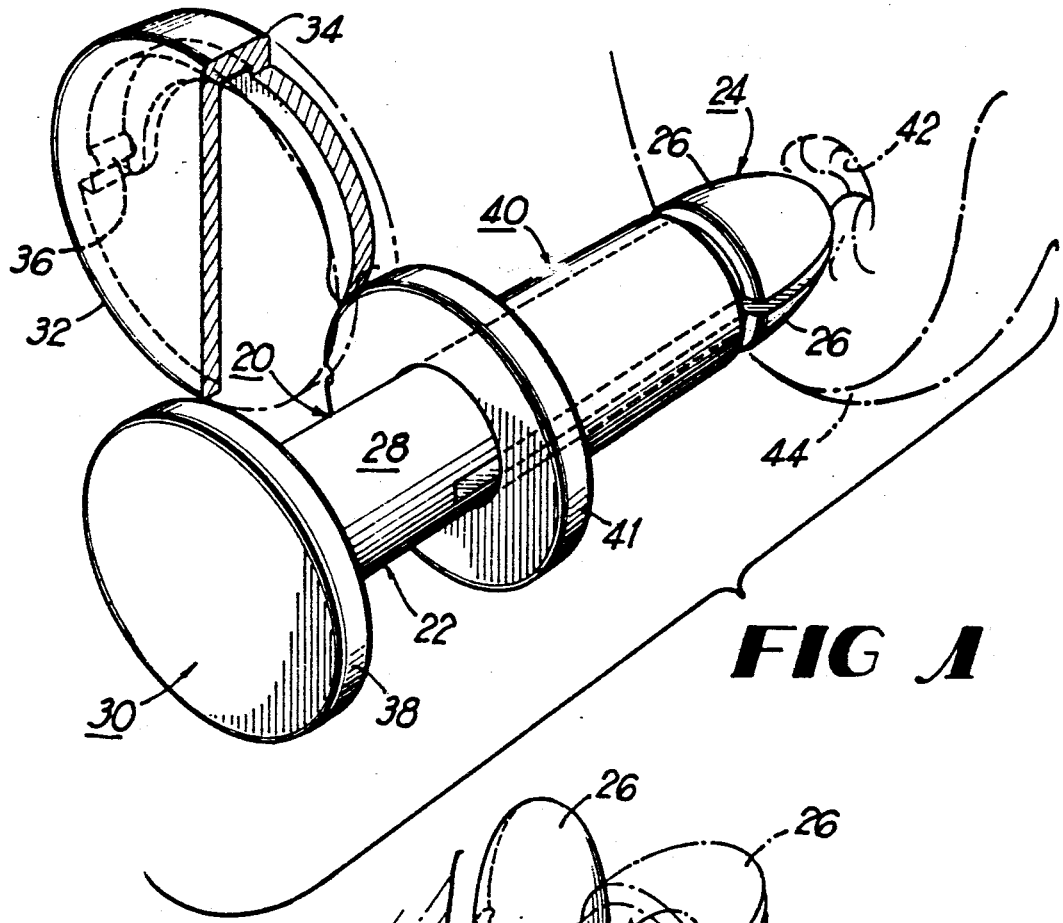
FIG. 1 perspective, partially exploded view of the present ready for insertion.

Referring now more specifically to the drawings, and to FIG. 1 in particular, numeral 20 designates generally the earring post for pierced ears. The invention has a shaft 22 with a distal end 24 that is split along the longitudinal axis thereof to provide one or more prongs 26 having an enlarged end portion 25 forming a pad. The proximal end 28 of the shaft 12 is provided with a face portion 30. The face portion may be disposed perpendicularly to the shaft 22 as shown, or it may be secured thereto at some other angle, the angular disposition thereof not being a limiting factor. Similarly, while illustrated as a disc-shaped member, other suitable shapes may also be employed. The face portion may be formed so as to be decorative itself, or it may serve as a base for mounting interchangeable decorative objects, such as a decorative cover 32. Where a decorative cover 32 is provided, it includes a rim or flange 34 which extends around the back edge of the cover with a securing bead 36 for engaging the rim 38 of the face portion 30. Disposed around the shaft 22 is sleeve means 40 which is slidably mounted thereon, the sleeve encompassing the mid-portion of the prongs and including an abutment means 41 at the end furthest from the distal end of the shaft.

As the distal end with the prongs is inserted into the hole 42 in the earlobe 44, the sleeve slides toward the proximal end 28 of the shaft as the abutment means 41 contacts the earlobe.

Figure 2:
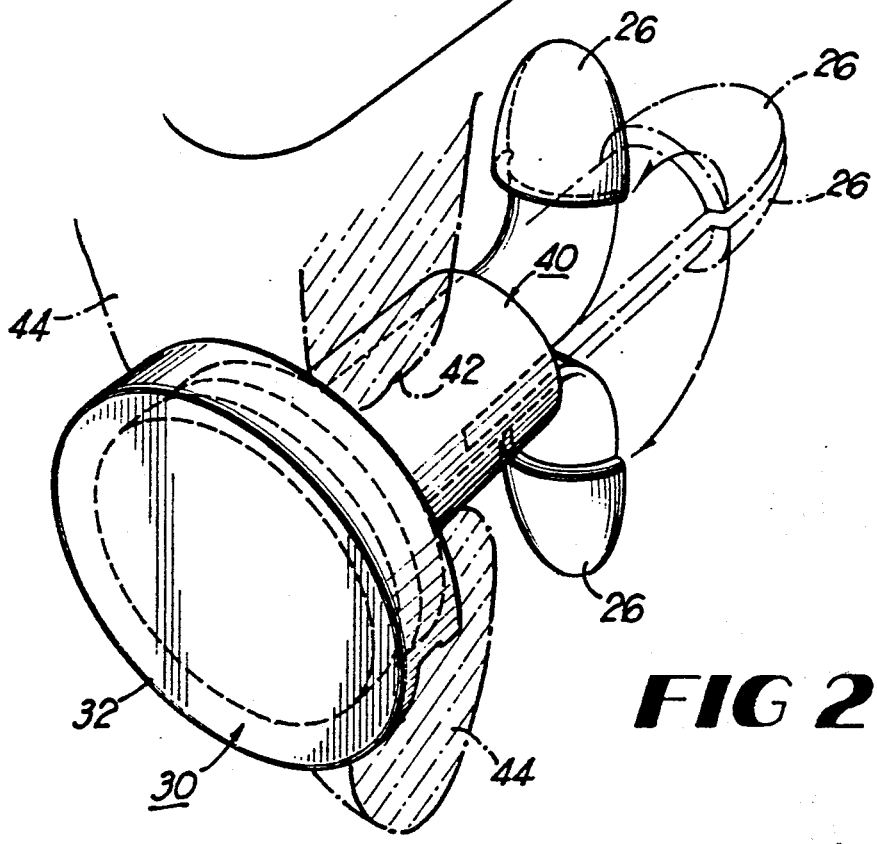
FIG. 2 is a perspective view of the invention in a secured position.
Figure 4:
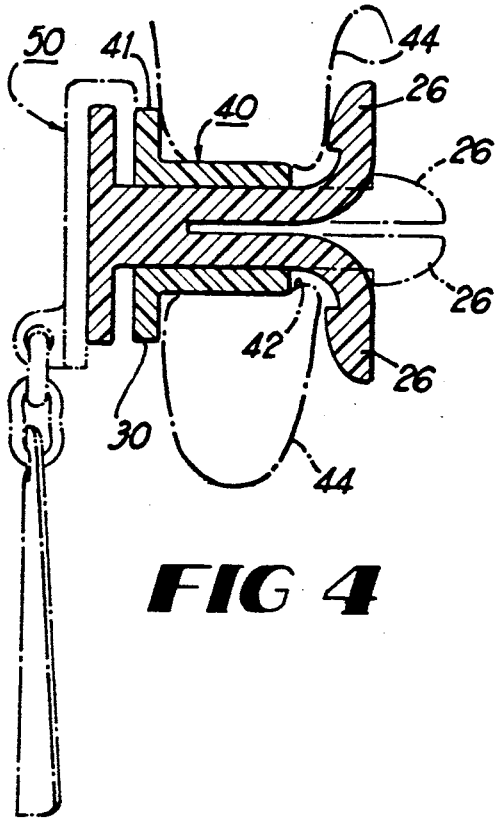
FIG. 4 is a cross sectional view of the present earring in s position.

The prongs are flexible and are biased such that their normal position is deflected or offset from the longitudinal axis of the shaft 22. Thus, the normal position of the prongs, in which they are in a resting state, is shown in FIG. 2 and FIG. 4. In this resting position with the prongs biased outwardly, they serve to retain the earring post in the earlobe with the pad 25 resting against the back of the earlobe. The present invention thus requires no additional securing means other than the integral securing means provided therewith. The elimination of the conventional back fastener as is required by all other known prior art designs provides significant advantages for the present invention.

Figure 3:
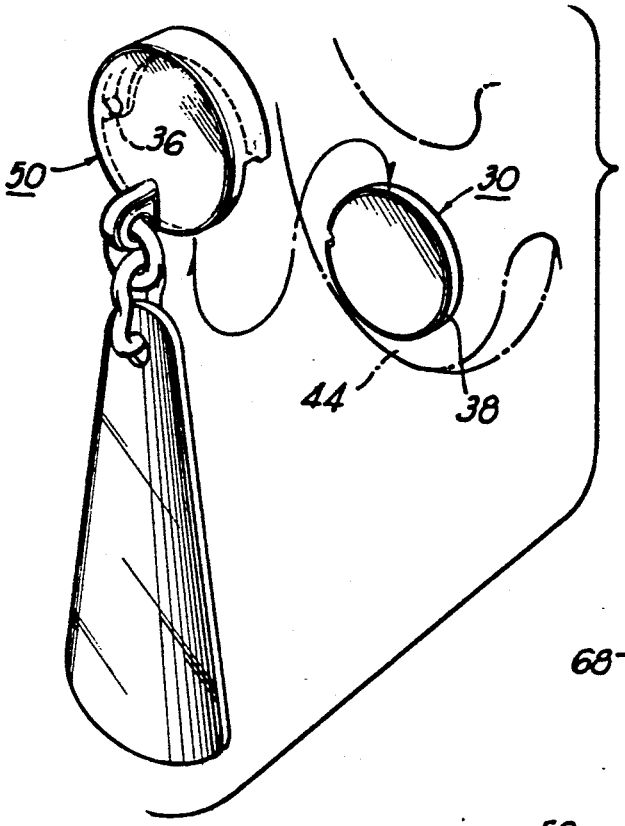
FIG. 3 a perspective, partially exploded view of the present invention in secured position.

As shown in FIGS. 3 and 4, the present invention can receive different ornamental members, such as decorative member 50 which is secured in the same manner as decorative member 32. In addition, other means of securing the decorative members to the face portion 30 may be employed, for example, adhesive means, hook and loop fasteners, or a ball and socket type arrangement.

Figure 5:
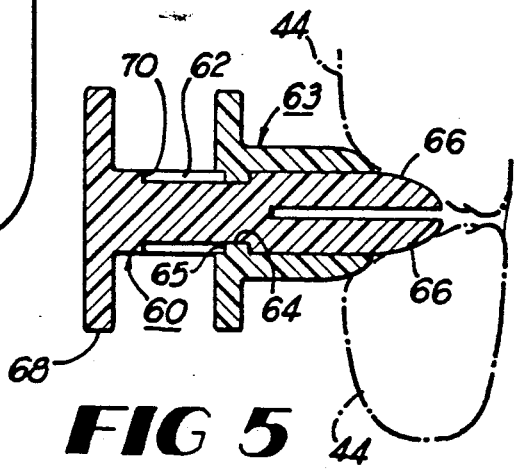
FIG. 5 is a cross sectional view of an alternate embodiment of the present invention ready for insertion.
Figure 6:
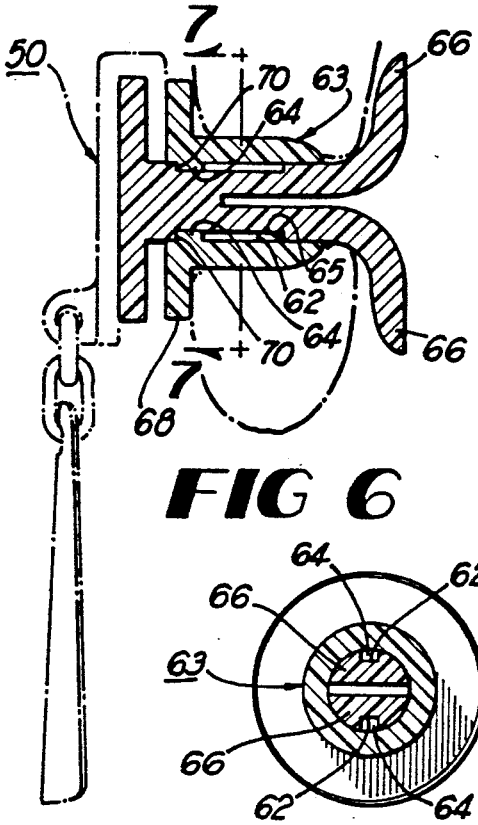
FIG. 6 is a cross sectional view of the embodiment shown in the preceding figure, shown in inserted position.
Figure 7:
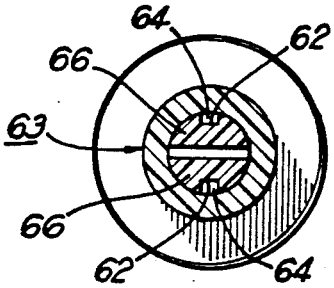
FIG. 7 is a cross sectional view of the embodiment shown in the preceding figure, the view being taken on line 7—7 of FIG. 6.

A similar but slightly altered embodiment is shown in FIGS. 5 through 7. In this embodiment, the shaft 60 is provided with an external slot means or guideway 62 with a defined length, and the sleeve 63 is provided with a corresponding tab means 64. Thus, as shown in sequence from FIG. 5 to FIG. 6, the sleeve 63 holds the prongs 66 together in a tensioned state and the contacting of tab means 64 with stop means 65 indicates that the sleeve 63 is in its fully extended position. As the sleeve is slid toward the face member 68, the tab means 64 travels along the guideway 62 and contacts a stop means 70 which is provided at the end of guideway 62 nearest the face member 68. This arrangement provides positive indication that the sleeve is fully retracted and that the prongs are in their outwardly biased position.

Figure 8:
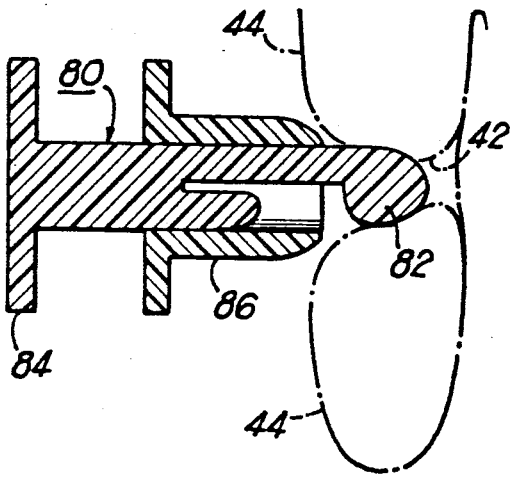
FIG. 8 is a cross sectional view of an alternate embodiment of the present invention, shown ready for insertion.
Figure 9:
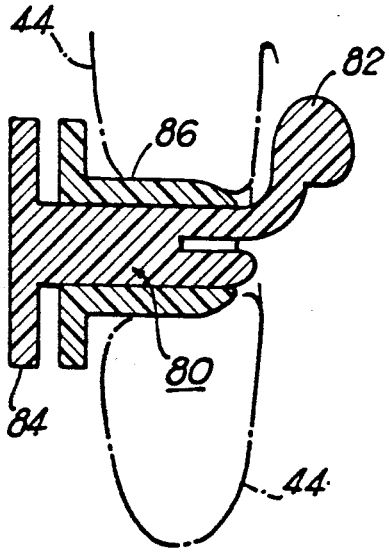
FIG. 9 is a cross sectional view of the embodiment shown in the preceding figure, shown in secured position.

Another embodiment of the present invention is illustrated in FIGS. 8 and 9. In this embodiment, the shaft 80 is provided with a single prong 82 having an enlarged distal end portion 85 forming a pad for insertion into the hole in the earlobe. The shaft includes a face portion 84 at the proximal end thereof, opposite the distal end with the prong. A sleeve 86 is disposed around the shaft and is slidable thereon. With the sleeve nearest the distal end, the prong is held in generally axial alignment with the shaft an is in a tensioned state. As the prong is inserted into the earlobe, the sleeve is slid toward the face portion 84, with the prong assuming its deflection or resting state with pad 85 adapted to bear against the back of the earlobe to secure the post in the earlobe.

Removal of the present post member is easily accomplished in all of the embodiments by sliding the sleeve toward the distal end with the tips of the prongs. The prongs are easily compressed to a position axially aligned with the respective shaft and the post can be easily withdrawn.

Figure 10:
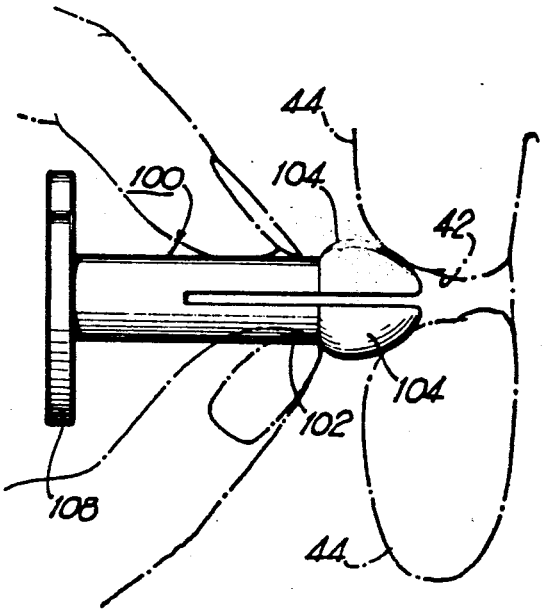
FIG. 10 is a side elevational view of an alternate embodiment of the present invention, shown in position for insertion.
Figure 11:
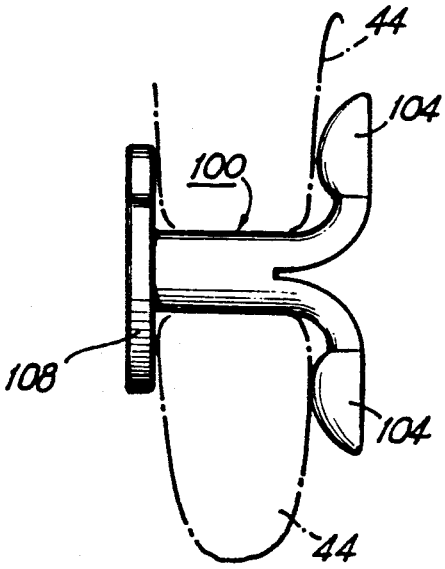
FIG. 11 is a side elevational view of the embodiment shown in the preceding figure, shown inserted into an earlobe.

A further alternate embodiment of the present invention is illustrated in FIGS. 10 and 11. In this embodiment the shaft 100 is split at its distal end 102 as in the prior embodiments, thereby providing prongs 104 having enlarged end portions 105 forming pads. The proximal end 106 of the shaft includes a face portion 108. The sleeve, however, is eliminated and the normally outwardly biased prongs are squeezed together with the fingers, as shown in FIG. 10, to place them in generally axial alignment with the shaft 100. With the prongs held together, they can be inserted through the hole in the earlobe. Once inserted, the prongs assume their resting state position, biased outwardly with the pads 105 resting against the rear of the earlobe to secure the post in the earlobe.

The description given hereinabove has focused on an earring post having one or two prongs. It is to be understood; however, that any number of prongs may be employed, and the foregoing disclosure of our invention is not meant to be limited in any way to one or two prongs. It is contemplated that the present invention be composed of a hypo-allergenic material such as plastic, which allows the invention to be quickly, easily, and inexpensively produced in a molding operation. Other hypo-allergenic materials, however, may be employed to produce the earring post. In addition, with a suitably shaped distal end, the present invention would be capable of being utilized in a piercing gun.

Thus, while an embodiment of an earring post for pierced ears and modifications thereof have been shown and described in detail herein, various additional changes and modifications may be made without departing from the scope of the present invention.

We claim:

1. An earring post for pierced ears comprising a shaft member having a proximal end and a distal end, said shaft member being split at said distal end and having at least one prong means having a distal end extending therefrom, said prong means having a first tensioned position being in generally axial alignment with said shaft member for insertion into the earlobe and a second resting position biased out of axial alignment with said shaft member wherein the distal end of said prong means is adapted to bear against the rear of the earlobe for retaining said post in the earlobe, and means adjacent the proximal end of said shaft member adapted to bear against the front of the earlobe.

2. An earring post for pierced ears comprising a shaft member having a proximal end and a distal end, said shaft member being split at said distal end and having at least one prong means extending therefrom, said prong means having an enlarged end portion forming a pad, said prong means further having a first tensioned position in generally axial alignment with said shaft member for insertion into the earlobe and a second relaxed position biased out a axial alignment with said shaft member with said pad being adapted to bear against the rear of the earlobe for retaining said post in the earlobe.

3. An earring post as defined in claim 2 in which said distal end includes a plurality of prong means extending therefrom.

4. An earring post as defined in claim 3 in which said post includes a sleeve member slidably mounted around said shaft member and having a first position disposed near said distal end for holding said prong means in axial alignment and a second position disposed near said proximal end for allowing said prong means to assume their biased relaxed state.

5. An earring post as defined in claim 2 in which said post includes a sleeve member slidably mounted around said shaft member and having a first position disposed near said distal end for holding said prong means in axial alignment and a second position disposed near said proximal end for allowing said prong means to assume its biased relaxed state.

6. An earring post as defined in claim 2 in which said proximal end includes a decorative member secured thereto.

7. An earring post as defined in claim 2 in which said proximal end includes a face portion secured thereto with a decorative member mounted on said face portion.

8. An earring post for pierced ears comprising a shaft member having a proximal end and a distal end, said shaft member being split at said distal end having a plurality of prong means formed thereby, each of said prong means having an enlarged end portion forming a pad, said prong means having a tensioned position in generally axial alignment with said shaft member for insertion into an earlobe and a relaxed position biased out of axial alignment with said shaft member with said pads being adapted to bear against the rear of the earlobe for retaining said post in the earlobe.

9. An earring post as defined in claim 8 in which said post includes a sleeve member slidably mounted around said shaft member and having a first position disposed near said distal end for holding said prong means in axial alignment and a second position disposed near said proximal end for allowing said prong means to assume their biased relaxed state.

10. An earring post as defined in claim 8 in which said proximal end includes a decorative member secured thereto.

11. An earring post as defined in claim 8 in which said proximal end includes a face portion secured thereto with a decorative member mounted on said face portion.

* * * * *